United States Patent [19]

Anderson

[11] 4,370,402

[45] Jan. 25, 1983

[54] DYE REDUCING COMPOSITION FOR DYE TRANSFERS, PHOTOGRAPHIC TRANSPARENCIES AND COLOR PRINTS

[76] Inventor: Harry Anderson, 83 Morgan St., Apt. 3 J, Stamford, Conn. 06905

[21] Appl. No.: 190,359

[22] Filed: Sep. 24, 1980

[51] Int. Cl.[3] ..... G03C 5/54; D06L 3/00

[52] U.S. Cl. ..... 430/237; 430/357; 430/358; 430/462; 430/455; 252/188.2; 8/110

[58] Field of Search ..... 430/462, 237, 357, 358, 430/455; 252/188.2; 8/108, 110

[56] References Cited

U.S. PATENT DOCUMENTS

| | | | |
|---|---|---|---|
| 2,564,238 | 8/1951 | Sprung | 430/462 |
| 4,186,008 | 1/1980 | Schar et al. | 430/462 |
| 4,254,215 | 3/1981 | Kramp et al. | 430/419 |
| 4,310,613 | 1/1982 | Iguchi et al. | 430/455 |

OTHER PUBLICATIONS

Mason–"Photographic Processing Chemistry", Focal Press, 1966, pp. 191–194.

*Primary Examiner*—Roland E. Martin, Jr.
*Assistant Examiner*—John L. Goodrow
*Attorney, Agent, or Firm*—Barry Kramer

[57] ABSTRACT

There is disclosed an aqueous composition for removing or reducing the intensity of dyes in dye transfers and the intensity of dyes used by photo retouchers on transparencies and color prints. The composition comprises, per 100 parts by weight of water, from about 1 to about 10 parts by weight of a thiourea and from about 5 to about 20 parts by weight of an ammonium nitrate compound. Application of this composition to dye transfers and/or to dyes used by photo retouchers on transparencies and color prints proportionally removes magenta, cyan and yellow dyes therefrom.

14 Claims, No Drawings

DYE REDUCING COMPOSITION FOR DYE TRANSFERS, PHOTOGRAPHIC TRANSPARENCIES AND COLOR PRINTS

DETAILED DISCLOSURE

This invention relates to compositions and methods for proportionally removing, and/or reducing the intensity of, dyes used in dye transfers and dyes used by photo retouchers on color transparencies and prints.

In the development of photographic images, there is frequently prepared a color film transparency (also known as a "chrome") which permits some alteration in color or tone, i.e., retouching. Additionally, "dye transfers" which are continuous tone prints printed in the three colors, magenta, cyan and yellow can be used for retouching when more work is required than can be done on a chrome or when the chrome is too small to permit sufficient working thereon. In the retouching process, it is generally necessary to remove entirely, or at least to reduce the intensity of, one or more of the three colors. Various chemical substances are available which act as solvents for one or more of these dyes. There are also available chemical compositions and combinations which purport to remove or reduce the intensity of all three dyes. For example, patent defensive publication No. T 883,013 discloses the use of a mixture of a 5-pyrazolone coupler and naphthol sulfonic acid to uncouple cyan dye and form a soluble dye which can be washed out of the film. Similarly, defensive publication T 896,053 discloses, for the same purpose, the use of an iodine and potassium iodide solution, followed by treatment with ammonium thiosulfate.

There are currently available various commercial formulations designed to remove dyes from dye transfers. For example, a weak solution (about 0.25%) of potassium permanganate can be used to remove cyan dye. Magenta dye can be removed with a product sold under the trademark Kodak Photo-Flo 200. For the removal of yellow dye, dilute (e.g. about 5%) solutions of sodium hypochlorite have been recommended, but results have not generally been satisfactory. Use of these various dye removers in combination generally results in removal or reduction of one or two of the three colors at a more rapid rate than the remaining color(s). It would be desirable to have a photographic dye removal/reducing agent which removes or reduces these colors proportionately.

Accordingly, it is a prime object of this invention to provide such a dye removal/reducing composition.

This invention provides an aqueous photographic dye removal or reducing composition comprising, per 100 parts of water, (1) from about 1 to about 10 parts by weight of a thiourea compound of the formula:

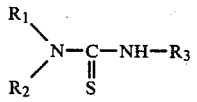

in which $R_1$ is hydrogen, methyl or ethyl, and $R_2$ and $R_3$ are each hydrogen or alkyl of from 1 to 4 carbon atoms, and (2) from about 5 to about 20 parts by weight of an ammonium nitrate compound. Preferably, the thiourea compound is present in an amount ranging from 2 to 6 parts by weight per hundred parts of water, more preferably about 4 parts by weight. Preferably, the ammonium nitrate compound is present in an amount of from 8 to 14 parts by weight per 100 parts of water, more preferably about 11 parts by weight.

The thiourea compounds usable in the compositions of this invention include thiourea, methyl thiourea, ethyl thiourea, n-propylthiourea, N,N-dimethylthiourea, N,N'-dimethylthiourea, trimethylthiourea, N-methyl-N'-n-butylthiourea, tert.butylthiourea, N-ethyl-N'-isopropylthiourea, etc. Preferably, the thiourea compound used is thiourea itself.

The ammonium nitrate compound usable in these compositions has the general formula:

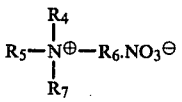

in which $R_4$ represents hydrogen; $C_1$–$C_{22}$ alkyl which may be mono- or poly-substituted by halogen or hydroxy or which may be interrupted by an amido group; or a $C_6$–$C_{10}$ aralkyl or alkaryl group optionally substituted by halogen or hydroxy, $R_5$ represents hydrogen, $C_1$–$C_8$ alkyl optionally substituted by halogen or hydroxy, or $C_6$–$C_{10}$ aralkyl or alkaryl optionally substituted by halogen or hydroxy, and each of $R_6$ and $R_7$ represents hydrogen or $C_1$–$C_4$ alkyl optionally substituted by halogen or hydroxy.

Preferably, the ammonium nitrate compound is one in which $R_4$ is hydrogen, $C_1$–$C_{22}$ alkyl optionally interrupted by an amido group, phenyl optionally mono- or di-substituted by $C_1$–$C_4$ alkyl or mono- to tri-substituted by chlorine or bromine, or benzyl, and $R_5$, $R_6$ and $R_7$ are hydrogen or $C_1$–$C_4$ alkyl optionally substituted by halogen or hydroxy.

Suitable ammonium nitrate compounds include ammonium nitrate itself, methyl ammonium nitrate, trimethyl ammonium nitrate, tetramethyl ammonium nitrate, ethyl ammonium nitrate, diethyl ammonium nitrate, tetraethyl ammonium nitrate, 2-hydroxyethyl ammonium nitrate, bis(2-hydroxy-ethyl) ammonium nitrate, trifluoromethyl ammonium nitrate, bromomethyl ammonium nitrate, dichloromethyl ammonium nitrate, 3-hydroxypropyl ammonium nitrate, trimethyl-n-pentyl ammonium nitrate, octyl ammonium nitrate, octylmethyl ammonium nitrate, dodecyl ammonium nitrate, stearyl ammonium nitrate, (stearamidomethyl) ammonium nitrate, stearyl, dimethyl-(2-hydroxyethyl) ammonium nitrate, (3-stearamidopropyl)-dimethyl-(2-hydroxyethyl) ammonium nitrate, diphenyl ammonium nitrate, diphenyl dimethyl ammonium nitrate, bis(2,4-dichlorophenyl) ammonium nitrate, dibenzylmethyl ammonium nitrate, di-n-propyl ammonium nitrate and the like.

These ammonium nitrate compounds are either readily available commercially or can be prepared from corresponding free base amines or their halide, hydrohalide, sulfate, etc., salts by methods well known in the art.

This invention also covers a method for proportionally removing magenta, cyan or yellow dyes from the dye transfers and from retouching dyes applied to transparencies and color prints by using the above-described aqueous composition. The composition is applied by methods well known in the art, for example, by the use of a sable brush or a cotton swab. After the dyes have been solubilized, the area is wiped, then washed with plain water or a weak acid solution such as, for example, a 2% aqueous solution of acetic acid. Use of the compositions of the present invention enable retouching to be effected quickly and conveniently without adversely affecting the photographic quality of the transparency, print or dye transfer.

The following example illustrates a composition and method according to this invention. It is included here for illustrative purposes only and should not be construed as a limitation.

EXAMPLE

To 320 cc of water, there was added 2.8 grams of thiourea and 36 grams of (2-hydroxyethyl)-dimethyl-(3-stearamidopropyl) ammonium nitrate, with thorough mixing. (This ammonium nitrate compound is available commercially from MCB Reagents, Norwood, Ohio.) A few drops of the resultant solution are placed in a dish. Employing a sable brush dipped in the solution, cyan, magenta and yellow dyes contained in a dye transfer are proportionally solubilized. In this instance, it was desired to remove all of the dyes from a small area and, when this was done, the area was wiped, then washed with a 2% aqueous solution of acetic acid. The first treatment removed the major portion of all of the dyes proportionally; i.e., the overall color of the treated area was substantially the same as the area prior to treatment, but with greatly reduced intensity. A second treatment with the solution completely removed all of the dyes. Despite the foregoing drastic reduction in dye intensity, the photographic quality of the dye transfer was unaffected.

What is claimed is:

1. An aqueous composition for removing dyes from or reducing dye intensity in photographic color dye transfers and for removing or reducing the intensity of retouching dyes in color transparencies and color prints, which composition comprises, per 100 parts by weight of water, from about 1 to about 10 parts by weight of a thiourea compound of the formula:

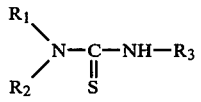

wherein $R_1$ is hydrogen, methyl or ethyl, and $R_2$ and $R_3$ are each hydrogen or alkyl of from 1 to 4 carbon atoms, and from about 5 to about 20 parts by weight of an ammonium nitrate compound of the formula

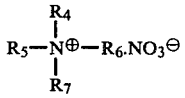

wherein $R_4$ represents hydrogen, $C_1$–$C_{22}$ alkyl which may be mono- or poly-substituted by halogen or hydroxy or which may be interrupted by an amido group; or a $C_6$–$C_{10}$ aralkyl or alkaryl group optionally substituted by halogen or hydroxy, $R_5$ represents hydrogen, $C_1$–$C_8$ alkyl optionally substituted by hydrogen or hydroxy, or $C_6$–$C_{10}$ aralkyl or alkaryl optionally substituted by halogen or hydroxy, and each of $R_6$ and $R_7$ represents hydrogen or $C_1$–$C_4$ alkyl optionally substituted by halogen or hydroxy.

2. A composition according to claim 1 in which the thiourea compound is present in an amount ranging from 2 to 6 parts by weight and said ammonium nitrate compound is present in an amount ranging from 8 to 14 parts by weight.

3. A composition according to claim 2 in which the thiourea is present in an amount of about 4 parts by weight, and said ammonium nitrate compound is present in an amount of about 11 parts by weight.

4. A composition according to claims 1, 2 or 3 in which the thiourea compound is thiourea.

5. A composition according to claim 1, 2 or 3 in which, in the ammonium nitrate compound $R_4$ is hydrogen, $C_1$–$C_{22}$ alkyl optionally interrupted by an amido group, phenyl optionally mono- or di-substituted by $C_1$–$C_4$ alkyl or mono- to tri-substituted by chlorine or bromine, or benzyl, and $R_5$, $R_6$ and $R_7$ are hydrogen or $C_1$–$C_4$ alkyl optionally substituted by halogen or hydroxy.

6. A composition according to claim 5 in which the ammonium nitrate compound is (2-hydroxyethyl)-dimethyl-(3-stearamidopropyl)-ammonium nitrate.

7. A method for proportionally removing magenta, cyan and yellow dyes from dye transfers and from retouching dyes used in color transparencies and color prints, which method comprises applying thereto an aqueous composition comprising, per 100 parts by weight of water, from about 1 to about 10 parts by weight of a thiourea compound of the formula:

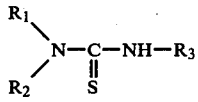

wherein $R_1$ is hydrogen, methyl or ethyl, and $R_2$ and $R_3$ are each hydrogen or alkyl of 1 to 4 carbon atoms, and from about 5 to about 20 parts by weight of an ammonium nitrate compound of the formula

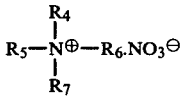

wherein $R_4$ represents hydrogen; $C_1$–$C_{22}$ alkyl which may be mono- or poly-substituted by halogen or hydroxy or which may be interrupted by an amido group; or a $C_6$–$C_{10}$ aralkyl or alkaryl group optionally substituted by halogen or hydroxy, $R_5$ represents hydrogen, $C_1$–$C_8$ alkyl optionally substituted by halogen or hydroxy, or $C_6$–$C_{10}$ aralkyl or alkaryl optionally substituted by halogen or hydroxy, and each of $R_6$ and $R_7$ represents hydrogen or $C_1$–$C_4$ alkyl optionally substituted by halogen or hydroxy.

8. A method according to claim 7 in which, in the composition, the thiourea compound is present in an amount of from 2 to 6 parts by weight, and said ammonium nitrate compound is present in an amount of from 8 to 14 parts by weight.

9. A method according to claim 8 in which, in the composition, the thiourea compound is present in an amount of about 4 parts by weight, and said ammonium nitrate compound is present in an amount of about 11 parts by weight.

10. A method according to claim 7, 8 or 9 in which the thiourea compound is thiourea.

11. A method according to claim 7, 8 or 9 in which, in the ammonium nitrate compound, $R_4$ is hydrogen, $C_1$–$C_{22}$ alkyl optionally interrupted by an amido group, phenyl optionally mono- or di-substituted by $C_1$–$C_4$ alkyl or mono- to tri-substituted by chlorine or bromine, or benzyl, and $R_5$, $R_6$ and $R_7$ are hydrogen or $C_1$–$C_4$ alkyl optionally substituted by halogen or hydroxy.

12. A method according to claim 11 in which the ammonium nitrate compound is (2-hydroxyethyl)-dimethyl-(3-stearamidopropyl)-ammonium nitrate.

13. A method according to claim 7 wherein after the desired extent of dye removal is effected, the so treated dye transfer, color transparency or color print is wiped and washed with water.

14. A method according to claim 7 wherein the treated dye transfer, color transparency or color print is wiped and washed with an aqueous solution of acetic acid.

* * * * *